US007927293B1

(12) United States Patent
Ignagni et al.

(10) Patent No.: US 7,927,293 B1
(45) Date of Patent: Apr. 19, 2011

(54) MEANS FOR CLEARING MUCUS FROM THE PULMONARY SYSTEM

(76) Inventors: Mario Ignagni, Brooklyn Park, MN (US); Thomas J. O'Dea, Shoreview, MN (US)

( * ) Notice: Subject to any disclaimer, the term of this patent is extended or adjusted under 35 U.S.C. 154(b) by 952 days.

(21) Appl. No.: 11/803,257

(22) Filed: May 14, 2007

(51) Int. Cl.
*A61H 1/00* (2006.01)
*A61H 7/00* (2006.01)
*A61H 19/00* (2006.01)

(52) U.S. Cl. ..... 601/46; 601/150; 601/151

(58) Field of Classification Search ..... 601/41–44, 601/46, 48, 71, 148–152
See application file for complete search history.

(56) References Cited

U.S. PATENT DOCUMENTS

| | | | | |
|---|---|---|---|---|
| 3,310,050 | A * | 3/1967 | Goldfarb | 601/79 |
| 3,955,563 | A | 5/1976 | Maione | |
| 4,838,263 | A | 6/1989 | Warwick et al. | |
| 5,235,967 | A | 8/1993 | Arbisi et al. | |
| 5,569,170 | A | 10/1996 | Hansen | |
| 5,924,448 | A * | 7/1999 | West | 137/565.13 |
| 6,190,337 | B1 | 2/2001 | Nedwell | |
| 6,958,046 | B2 | 10/2005 | Warwick et al. | |
| 6,984,214 | B2 | 1/2006 | Fowler-Hawkins | |
| 7,096,866 | B2 | 8/2006 | Be'eri | |
| 7,617,821 | B2 * | 11/2009 | Hughes | 128/200.24 |
| 2004/0173220 | A1 * | 9/2004 | Harry et al. | 128/892 |
| 2005/0148909 | A1 * | 7/2005 | Weil et al. | 601/41 |
| 2006/0089575 | A1 * | 4/2006 | DeVlieger | 601/70 |
| 2007/0239087 | A1 * | 10/2007 | Kivisto | 601/44 |
| 2008/0108914 | A1 * | 5/2008 | Brouqueyre et al. | 601/2 |

* cited by examiner

*Primary Examiner* — Kristen C Matter

(57) ABSTRACT

An apparatus for clearing mucus from the pulmonary system, utilizing two different types of external excitation applied concurrently to the thorax, the first type of excitation consisting of vibrational stimulations, and the second type of excitation consisting of compressive stimulations, with control means provided to regulate the two excitation means.

10 Claims, 4 Drawing Sheets

MEANS FOR CLEARING MUCUS FROM THE PULMONARY SYSTEM

FIELD OF THE INVENTION

The invention generally relates to the use of mechanical stimulation of the thorax to promote clearance of mucus from the lungs and trachea.

BACKGROUND OF THE INVENTION

A number of diseases can lead to severe impairment of normal lung functioning. Among these are: Cystic Fibrosis, Emphysema, and Immotile Celia Syndrome. Cystic Fibrosis is a hereditary disease that leads to the accumulation of large quantities of viscous mucus in the lungs. Emphysema causes impairment of the lung's ability to clear mucus as a result of damage to the celia, the small hair-like vibrating appendages covering the lung wall that loosen and help propel the mucus out of the lung; and damage to the alveoli, the small air sacs covering the lung surface, which are instrumental in coughing mucus out of the lungs. Immotile Celia Syndrome is a hereditary disease in which the normal functioning of the celia is absent or impaired, leading to the accumulation of mucus in the lungs. In all of these diseases, mucus retained in the lungs becomes a natural breeding ground for harmful bacteria that can cause repeated bouts of serious infections, as well as leading to decreased respiratory gas exchange.

In addition to drugs and inhalants, various physical therapies may be applied to assist in expelling mucus from the pulmonary system. In particular, patients may undergo chest percussion by a trained physical therapist to loosen lung mucus, which is followed by postural drainage and coughing to expel the mucus from the lungs. This can be a time consuming and discomforting therapy which meets with only limited success, especially if the patient is in a weakened condition.

More recently, high-frequency chest compression techniques have been employed as a means of eliminating the need for a physical therapist, and to improve effectiveness of mucus clearance from the lungs. Such techniques have been taught by Warwick and Hansen, U.S. Pat. No. 4,838,263; Hansen, U.S. Pat. No. 5,569,170; and Warwick and Hansen, U.S. Pat. No. 6,958,046. High-frequency chest compression, as applied by an inflatable vest, has been shown in clinical trials and in actual use to be efficacious in clearing mucus from the lungs. However, a patient may require 2 to 3 hours of treatment each day to keep the lungs relatively free of mucus.

The present invention addresses the need for a more effective approach to clearing mucus from the pulmonary system that will reduce physical stress to the body, and require less time in the daily regimen of treatment.

BRIEF SUMMARY OF THE INVENTION

A first source of excitation applies vibrational stimulations directly to the thorax which, in turn, causes the pulmonary system to develop small-amplitude sympathetic vibrations, thereby loosening the mucus attached to the lungs and trachea. A second independent source of excitation applies compressive stimulations to the patient just below the rib cage, leading to upward thrusts of the thoracic diaphragm. Since the lungs rest directly on the thoracic diaphragm, localized motions of the lung walls will be initiated at the points of contact. This causes the air in the lungs to experience pressure and flow-rate pulsations which, in turn, cause the mucus attached to the lungs and trachea to be propelled in incremental steps toward the mouth. Control means are provided to insure that efficacious pulmonary system vibration and thoracic compressions are achieved without undue stress to the patient. The use of two separately controllable thoracic excitation sources offers greater potential for optimization than a single excitation, as applied by existing high-frequency chest compression techniques, and may have advantages in size, cost, mucus clearance rate, and reduced physical stress to the body.

DETAILED DESCRIPTION OF THE INVENTION

Figure 1:
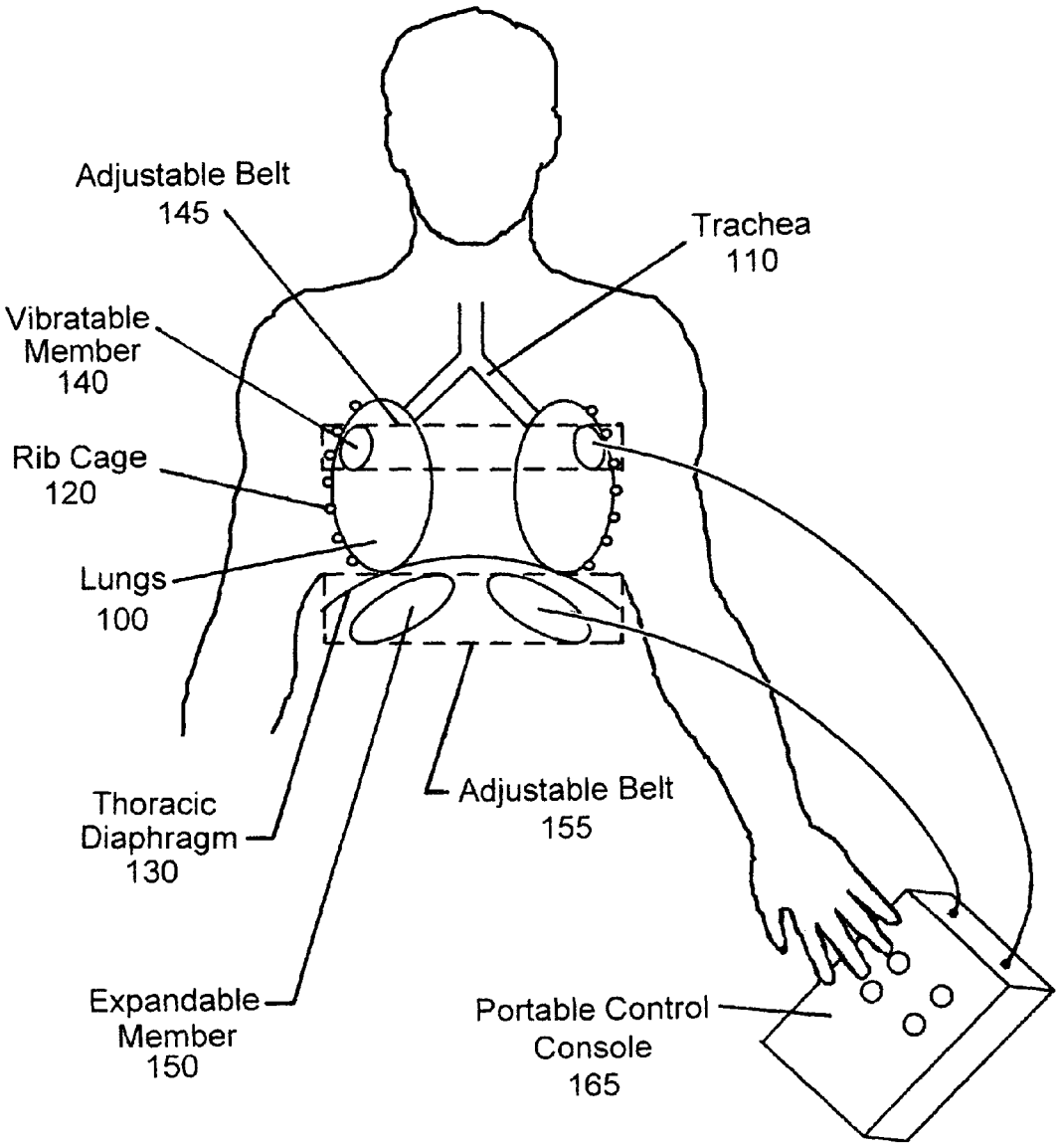
FIG. 1 illustrates the parts of the body which are affected by the external excitations, and the primary elements used in generating the excitations.

FIG. 1 illustrates the concept for clearing the lungs (100) and trachea (110) of mucus. The concept is based on the employment of two separately controllable excitations, in combination, to maximize the effectiveness of mucus clearance from the pulmonary system. The first excitation augments the action of the cilia by inducing sustained low-amplitude high-frequency vibrations in the lungs (100). This serves to create continuous oscillatory translational motions of the lung wall relative to the mucus which, in turn, expedites movement of the mucus. Vibration of the lung walls is achieved by employing at least one vibratable member (140) held in contact with the thorax. From a physical perspective, the lung wall behaves essentially like a perfect elastic membrane, while the mucus does not. Accordingly, because the lung wall and mucus respond differently in a vibrational environment, relative motion will occur between them, which creates a boundary layer of lower viscosity mucus adjacent to the lung wall, thereby increasing mucus mobility.

Given that sustained vibration of the lung wall expedites the movement of mucus, the second function of propelling the mucus along the lung wall is achieved by mechanically pumping the air in the lungs (100) utilizing compressive stimulations of the lower thorax, characterized by a much higher amplitude and lower frequency than the vibrational stimulations. Compression of the lower thorax is achieved by employing at least one expandable member (150) held in contact with the thorax, which leads to upward thrusts of the thoracic diaphragm (130). The pressure and flow-rate variations of the air enclosed within the lungs (100), induced by the upward thrusts of the thoracic diaphragm (130), create the motive forces required to propel the mucus in incremental steps toward the mouth, where it can be swallowed or expectorated.

The first excitation means for applying vibrational stimulations to the thorax can take various forms. In one exemplary application, the vibrational stimulations could be applied by one or more well-known mechanical vibrators which transmit inertial reaction forces to the thorax. In still another exemplary application, the vibrational stimulations could be applied by sonic waves originating from one or more audio speakers. In yet another exemplary application, the vibrational stimulations could be applied by an inflatable pneumatic belt or cuff that causes oscillatory compressive forces to be transmitted to the thorax. More than one vibration-generating device would typically be utilized, with vibration applied symmetrically to the thorax, allowing the lungs (100) and the trachea (110) to be stimulated. In one exemplary application, the vibration-generating devices would be held in contact with the thorax by an adjustable belt (145). In still another exemplary application, the vibration-generating devices would be attached to the back or side of a chair, and the thorax positioned such that direct contact is maintained with the vibration generators.

Since each patient generally responds differently to external vibrational stimuli, control means are required to regulate these stimulations, such that the vibrations transmitted to the pulmonary system are effective in increasing the mobility of the mucus attached to the lungs (100) and trachea (110) without causing undue stress to the patient. This will depend both on the degree of mucus congestion, and on the mechanical properties of the lungs (100) and rib cage (120). For example, the lung resonant frequency of a small child will be approximately twice that of an adult. Furthermore, the lung resonant frequency will generally be significantly different when the lungs (100) are congested with mucus. A second physical difference between patients is the rib-cage resonant frequency, which has an important influence on the efficacy of the vibrational stimulations. Since the lungs (100) can be vibrated both directly, and indirectly as a response to vibration of the rib cage (120), mucus loosening will benefit from both types of excitation. Also, generally, for a given spectral content of the vibrational energy transmitted to the thorax, efficacy of mucus clearance from the lungs (100) and trachea (110) will depend directly on the intensity of the vibrations, which should be subject to regulation by the patient or caregiver to achieve the desired benefit without undue stress.

Regulation of the vibrational stimulations is achieved by employing a portable control console (165)operated by the patient or caregiver. This would generally include the ability to regulate the vibration spectrum applied to the thorax, as well as the intensity of the vibrations in a well-known manner. It is also important that the patient or caregiver be given the means to terminate the vibrational excitations, both as a safety measure, and to allow the patient time to rest or cough. Application of vibration during the inspiration phase of the breathing cycle may also be undesirable for some patients, and could be discontinued during this part of the respiratory cycle.

A general set of specifications placed on the control console (165) that allows regulation of the vibrational excitations is defined by:

- a power cable input for conveying standard AC power from a wall outlet;
- an AC to DC converter;
- a microprocessor for implementing control means for regulating the vibrational stimulations;
- software algorithms embedded in the microprocessor for generating commands to the vibration generators;
- digital to analog converter for generating an analog voltage command to the vibration generators;
- an amplifier for adjusting the amplitude of the analog voltage command to the vibration generators;
- one or more control knobs allowing adjustment of the spectral content of the vibrational stimulations;
- a control knob allowing adjustment of the intensity of the vibrational stimulations; and
- a dormancy button which terminates application of the vibrational stimulations upon release.

The control console (165) serves as the energizing source for the vibrations generators using well-known means in the art. It performs this function by receiving standard AC power from a wall outlet via an input power cable. However, because the vibration generators would typically utilize a DC input, an AC to DC converter would need to be provided. To allow a control signal responsive to a broad range of patient needs to be synthesized, a microprocessor for generating the control signal input to the vibration generators would be required. Applicable software algorithms for generating digitized commands to the vibration generators would be embedded in the microprocessor. An analog voltage input to each vibration generator, provided by a digital to analog converter, would be passed through an amplifier to allow the voltage level to be adjusted as required.

Figure 2:
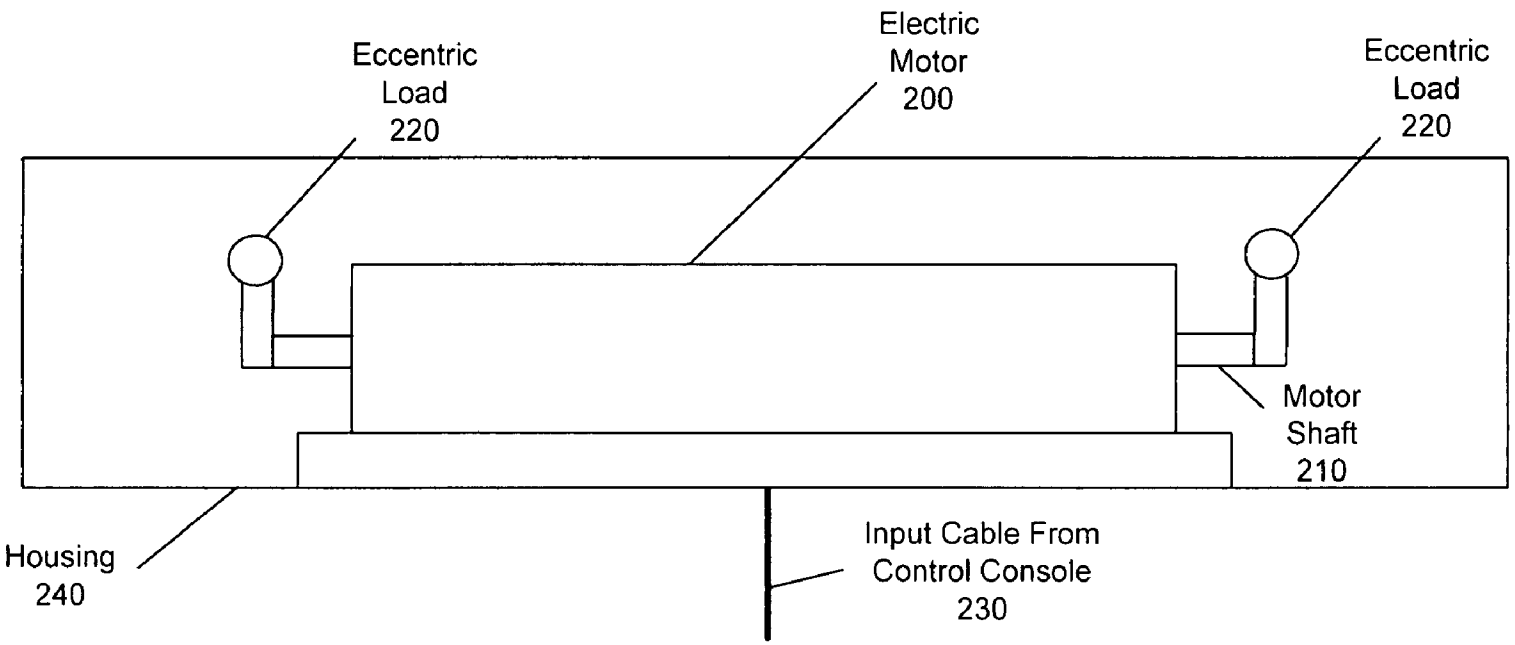
FIG. 2 illustrates an exemplary embodiment for transmitting vibrational stimulations to the thorax.

FIG. 2 illustrates an exemplary embodiment for creating vibrational excitations to the thorax. Vibration is achieved in this exemplary application by employing a small electrical motor (200), with eccentric load (220), to create inertial reaction forces. The electric motor (200) could be a servo motor responsive to a continuous command input, or a stepper motor responsive to a high-frequency stream of discrete incremental positioning commands. To minimize the creation of undesirable rotary vibrations, the electric motor (200) would have both ends of a single motor shaft (210) accessible for mounting identical eccentric weights, and be mounted such that the center of gravity of the combination of electric motor (200), motor shaft (210), and eccentric load (220) is coincident with the center of gravity of the housing (240). An input cable (230) provides voltage commands to the electric motor (200), allowing its speed to be controlled in a desired manner, with the opposite end of the cable being connected to the control console.

In the exemplary embodiment of FIG. 2, the perpendicular force transmitted to the thorax is defined by $$F = \frac{2Wr\omega^2}{g}\sin\omega t \tag{1}$$

where

F=perpendicular force applied to thorax

W=weight of each eccentric mass g=acceleration due to gravity

ω=angular velocity of motor shaft r=radial distance from motor spin axis to center of mass of eccentric load t=time It is seen that the perpendicular force defined by (1) varies sinusoidally and, for a constant spin rate of the electric motor (200), has a constant peak amplitude. More generally, if the spin rate of the electric motor (200) varies cyclically about a constant mean value, addition sinusoidal components at frequencies both higher and lower than the basic spin frequency will be generated. The weight of the eccentric load (220) used in the vibrator should be periodically re-evaluated to insure compatibility with a particular patient's needs. As a patient ages, and grows in size and weight, his physical response to the vibrations will change, and this should be reflected in the weights used.

The application of vibration to the pulmonary system causes a significant increase in the mobility of the mucus attached to the lungs (100) and trachea (110); however, in itself, the vibration has little potential for expelling mucus from the pulmonary system. To accomplish the latter, a second type of excitation is required which applies compressive stimulations to the lower thorax, inducing a series of huffs. Application of compressive stimulations to the lower-thoracic region can be achieved by various well-known means. In one exemplary application, an electromechanical actuator would be used to apply compressive forces directly to the thorax. In still another exemplary application, the compressive stimulations would be transmitted by means of one or more inflatable bladders held against the thorax by an adjustable belt (155), and pressurized by a controlled source of pneumatic pressure. In yet another exemplary application, the compressive stimulations would be transmitted by means of a single inflatable cuff or belt, secured around the lower thorax, and pressurized by a controllable source of pneumatic pressure As in the case of the vibrational stimulations, the compressive stimulations need to be controlled to reflect patient-specific requirements, and to achieve overall efficacy without discomfort to the patient. The objective of the control scheme is to regulate the compressions of the lower-thoracic region in a well-known manner which creates simultaneous increases in the pressure and expiration rate of air contained within the lungs (100) and trachea (110), thereby leading to a series of huffs. Then, together with concurrent application of the vibrational stimulations, the compressive stimulations will cause the desired incremental movements of the mucus along the lung and tracheal walls. Generally, compressive stimulations would be applied only during the expiration phase of the respiratory cycle, and inhibited by the patient or caregiver during the inspiration phase.

The control console (165) provides the means by which the patient or caregiver may regulate the compressive stimulations to the lower thorax in a well-known manner. To accomplish this, additional control console features are required, as follows:

- software algorithms embedded in the microprocessor for generating commands to the actuator producing the compressive stimulations;
- a digital to analog converter for generating an analog voltage input to the actuator;
- an amplifier for adjusting the amplitude of the analog voltage input to the actuator;
- an electrical cable for transmitting the electrical voltage to the actuator;
- a control knob allowing adjustment of the frequency of the compressive stimulations;
- a control knob allowing adjustment of the amplitude of the compressive stimulations; and
- a dormancy button which terminates application of the compressive stimulations upon release.

The control console (165) serves as the energizing source for the actuator producing the compressive stimulations. It performs this function by utilizing the available standard AC power. However, because the actuator would typically utilize a DC input, an AC to DC converter would be required. A microprocessor for implementing the control signal input to the actuator would also be provided. Applicable software algorithms for generating digitized commands to the actuator would be embedded in the microprocessor. An analog voltage input to the actuator would be provided by a digital to analog converter and this, in turn, would be adjusted by an amplifier before being passed on to the actuator.

Figure 3:
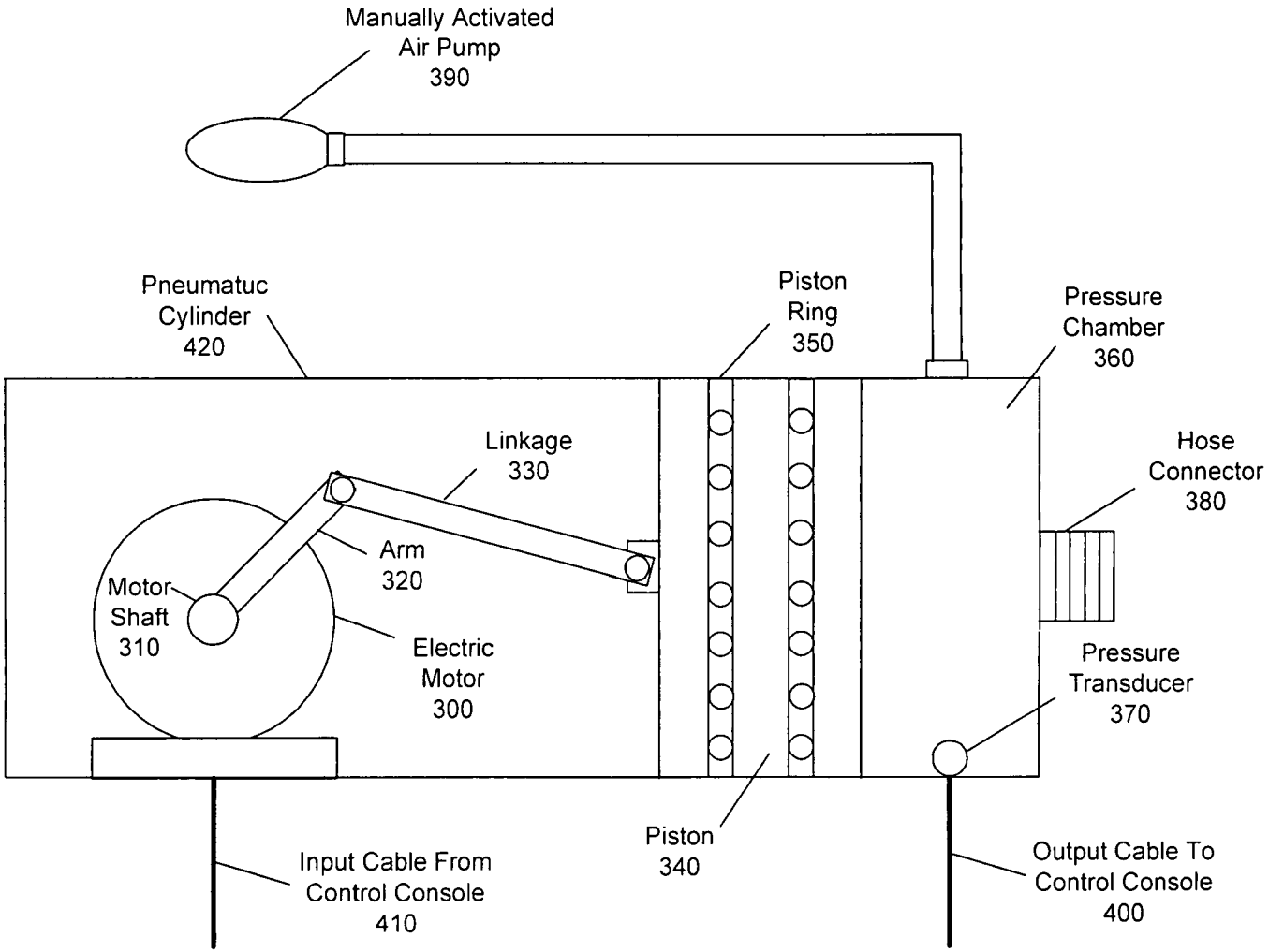
FIG. 3 illustrates an exemplary embodiment for producing pneumatic pressure variations.

FIG. 3 depicts an exemplary embodiment for creating compressive stimulations to the lower-thoracic region. In this exemplary embodiment the compressive stimulations are provided by a pneumatic cylinder (420) which applies compressions by means of at least one expandable member (150) held in contact with the lower-thoracic region by a belt (155). To insure efficacy and safety, control means are provided to regulate the compressive stimulations applied to the thorax. This would normally take the form of a well-known amplitude control allowing adjustment of the amplitude of the compressive stimulations transmitted to the lower-thoracic region, and a well-known frequency control allowing adjustment of the frequency of the compressive stimulations.

In the exemplary embodiment illustrated in FIG. 3, an electric motor (300) is employed for converting an electrical control signal input into a translational motion of a piston (340) contained within a pneumatic cylinder (420). Piston rings (350) allow the piston (340) to operate with a minimum of friction, and also provide a seal between the compartment of the pneumatic cylinder (420) housing the electric motor (300), and the pressure chamber (360). The electric motor (300) creates a rotary motion of the motor shaft (310) and arm (320) which, in turn, causes translational motion of the piston (340) via motion of the linkage (330). The translational motion of the piston (340), in turn, causes pressure buildup in the pressure chamber (360), which leads to pressure variation in the air flow from the pneumatic cylinder (420). The electric motor (300) receives a control signal that positions the motor shaft (310) via an electrical input cable (410), which has its opposite end connected to the control console. A pressure transducer (370) generates an electrical signal responsive to the pressure of the air in the pressure chamber (360) of the pneumatic cylinder (420). In addition, an electrical output cable (400) for transmitting the voltage from the pressure transducer (370) to the control console is provided. FIG. 3 also shows an optional manually-activated air pump (390) for creating a desired quiescent pressure in the pressure chamber (360) when the piston (340) is in its null position. The manually activated air pump (390) could be used as an alternative to positioning the piston (340) as the means of creating a desired quiescent pressure in the pressure chamber (360). A desired value of the quiescent pressure can be conveniently set using the output of the pressure transducer (370).

The embedded software hosted in the microprocessor controls the pressure variations transmitted to each expandable member (150) in a well-known manner such that the desired lung pressure/flow-rate response is produced. The control is intended to produce a series of huffs, each of which causes a buildup of pressure and flow rate of air within the lungs (100) that serves to propel the mucus in incremental steps out of the lungs (100) and trachea (110). The objective is to produce compressions that build up and terminate smoothly, such that the patient experiences minimal discomfort. Normally, a number of individual compressions would be applied during the expiration phase, the goal being approximately two to three if possible. However, when a great deal of lung congestion exists, the patient may experience very shallow breathing, in which case only a single compression of the lower-thoracic region may initially be possible during expiration. The availability of the pressure transducer (370) allows closed-loop control of the electric motor (300), such that a desired pressure variation can be transmitted to each expandable member (150). The control algorithms would be hosted in the microprocessor, and operate on the difference between the pressure measured by the pressure transducer (370) and a desired pressure profile. A digital realization of the pressure measured by the pressure transducer (370) would be obtained by employing an analog to digital converter located in the control console.

Figure 4:
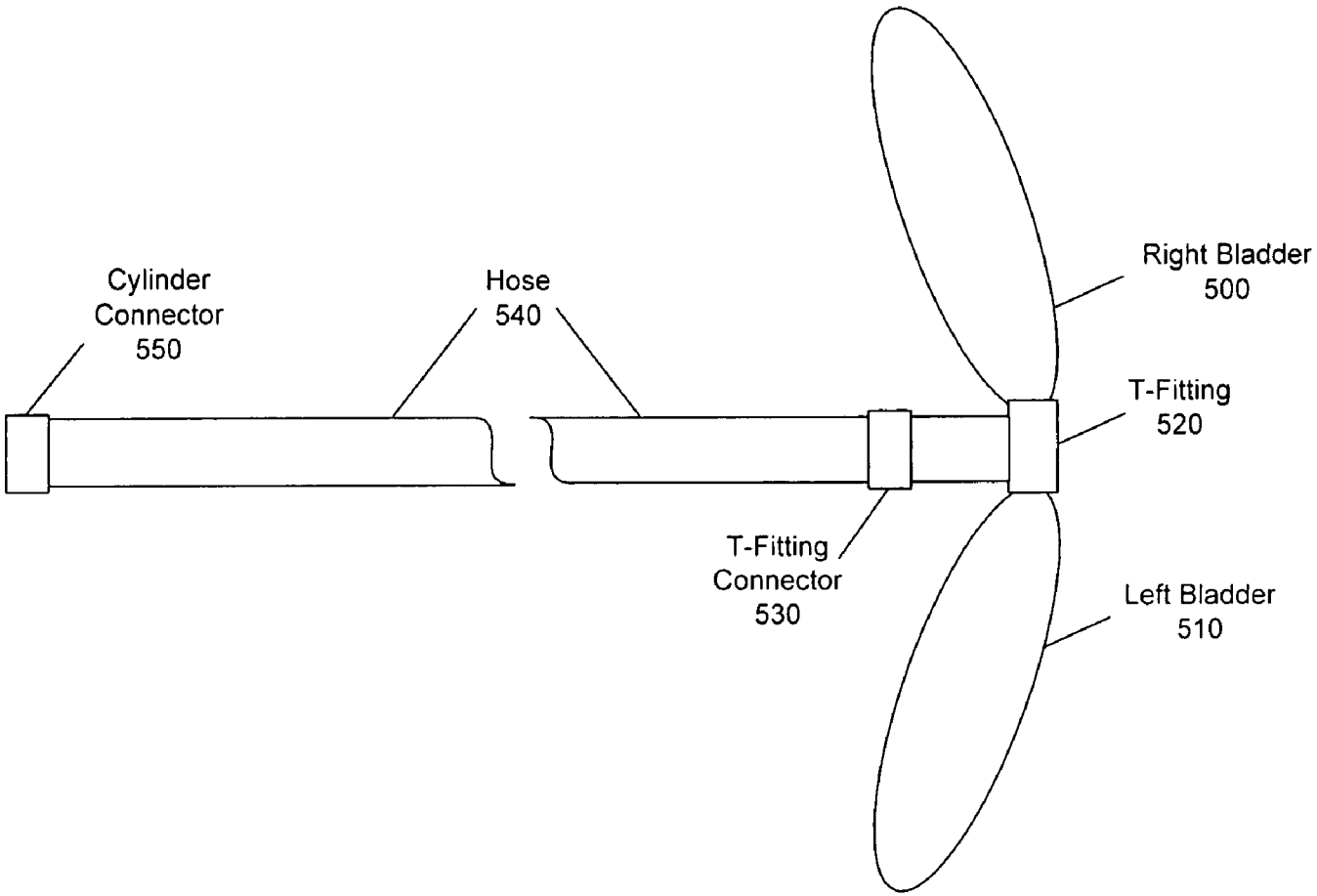
FIG. 4 illustrates an exemplary embodiment for transmitting pressure stimulations to the thorax.

FIG. 4 illustrates an exemplary embodiment for applying compressive stimulations to the lower-thoracic region. A plurality of at least one inflatable bladder held in contact with the lower-thoracic region receives the pressurized air flow from the pneumatic cylinder (420) via a hose (540) connected to the pneumatic cylinder (420) by means of a hose connector (380). In this exemplary embodiment, two symmetrically disposed inflatable bladders, the right bladder (500) and the left bladder (510), are used to provide compressive stimulations to the abdominal wall and thoracic diaphragm (130). The use of two bladders held symmetrically against the lower thorax allows compressive forces to be transmitted to both lungs (100) via the abdominal wall and thoracic diaphragm (130). A single hose (540) connected to the pneumatic cylinder (420) conveys the compressed air to the right bladder (500) and left bladder (510) via a T-fitting (520). The hose (540) is connected to the pneumatic cylinder (420) by means of a cylinder connector (550), and to the T-fitting by means of a T-fitting connector (530). The right bladder (500) and left bladder (510) can be held firmly against the lower-thoracic region by means of a non-extensible belt, as is well known in the art, which causes the compressive forces to be directed inwardly against the lower-thoracic region as is well known in the art.

The embodiments described herein are sufficiently detailed to allow those skilled in the arts to practice the claimed invention, and it is understood that other embodiments may be utilized without departing from the true spirit of the claimed invention.

What is claimed is:

1. An apparatus for clearing mucus from the pulmonary system of a human, comprised of:

means for applying first external stimulations to the thorax of said human, whereby said first stimulations are low-amplitude, high-frequency stimulations adapted to cause vibrations to be transmitted to the pulmonary system comprised of the lungs and trachea of said human;

first control means to regulate said first external stimulations, whereby said vibrations transmitted to said pulmonary system are adapted to cause the mobility of mucus attached to said lungs and trachea to be increased;

means for applying second different external stimulations to said thorax, whereby said second different stimulations are high-amplitude, low-frequency stimulations adapted to cause compressions of the lower-thoracic region comprised of the abdominal wall and thoracic diaphragm of said human;

second control means to regulate said second different external stimulations, whereby said compressions of said lower-thoracic region are adapted to cause induced expiration responses in said pulmonary system, whereby simultaneous increases in the pressure and expulsion rate of air contained within said lungs and trachea occur in use; and a control console activated by the patient or caregiver, whereby desired levels and temporal variations of said first external stimulations and said second different external stimulations are applied to said thorax in use;

whereby concurrent application of said first external stimulations and said second different external stimulations to said thorax is adapted to cause movement of said mucus from said lungs and trachea.

2. The apparatus of claim 1, wherein said means for applying said first external stimulations to said thorax is further comprised of:

at least one vibratable member adapted to be held in contact with said thorax by an adjustable restraining device, whereby said first external stimulations are transmitted to said thorax in use.

3. The apparatus of claim 2, further comprised of:

a first electromechanical actuator for converting an electrical voltage into an oscillatory motion of an inertial mass; and a housing for containing said first electromechanical actuator and said inertial mass, said housing is adapted to be held against said thorax by said adjustable restraining device, whereby inertial reaction forces are transmitted to said thorax in use.

4. The apparatus of claim 3, further comprised of:

a power cable input for conveying standard AC power from a wall outlet;

an AC-to-DC converter;

a microprocessor for implementing said first control means;

a set of software algorithms embedded in said microprocessor for generating digital commands to said first electromechanical actuator;

a digital-to-analog converter for generating an analog voltage input to said first electromechanical actuator from said digital commands;

an amplifier for adjusting the amplitude of said analog voltage input to said first electromechanical actuator; and an electrical cable providing said analog voltage to said first electromechanical actuator, said electrical cable having its opposite end connected to said amplifier.

5. The apparatus of claim 1, wherein said control console is further comprised of:

a frequency control allowing adjustment of the frequency of said first external stimulations;

an amplitude control allowing adjustment of the amplitude of said first external stimulations; and a dormancy button which terminates application of said first external stimulations upon release.

6. The apparatus of claim 1, wherein said means for applying said second different external stimulations to said thorax is further comprised of:

at least one expandable member adapted to be held in contact with said thorax by an adjustable restraining device, whereby said second different external stimulations are transmitted to said lower-thoracic region in use.

7. The apparatus of claim 6, further comprised of:

a second electromechanical actuator for converting an electrical control signal input into a translational motion of a piston contained within a pneumatic cylinder, whereby said translational motion of said piston causes pressure variations in air flow from said pneumatic cylinder;

at least one inflatable bladder is adapted to be held in contact with said lower-thoracic region for receiving said air flow from said pneumatic cylinder;

a hose for connecting said pneumatic cylinder to said at least one inflatable bladder, whereby said pressure variations are transmitted to said at least one inflatable bladder;

an optional manually activated air pump for creating a desired quiescent pressure in said pneumatic cylinder; and a pressure transducer responsive to the pressure in said pneumatic cylinder.

8. The apparatus of claim 7, further comprised of:

a microprocessor for implementing said second control means;

a set of software algorithms embedded in said microprocessor for generating translational commands to said second electromechanical actuator for positioning said piston within said pneumatic cylinder;

a digital-to-analog converter for generating an analog voltage input to said second electromechanical actuator for positioning said piston within said pneumatic cylinder;

an analog-to-digital converter for generating a digital realization of the voltage output of said pressure transducer;

an amplifier for adjusting the amplitude of said analog voltage input to said second electromechanical actuator for positioning said piston within said pneumatic cylinder;

an electrical cable for transmitting said analog voltage input to said second electromechanical actuator for positioning said piston within said pneumatic cylinder, said electrical cable having its opposite end connected to said amplifier; and an electrical cable for transmitting an electrical voltage output from said pressure transducer to said microprocessor.

9. The apparatus of claim 8, further comprised of:

a software module for generating a feedback control signal to said second electromechanical actuator for positioning said piston, said feedback control signal being proportional to the difference between a desired pressure variation profile and the actual pressure variation profile measured by said pressure transducer.

10. The apparatus of claim 1, wherein said control console is further comprised of:

a control allowing adjustment of the amplitude of said second different external stimulations;

a control allowing adjustment of the frequency of said second different external stimulations; and a dormancy button which terminates application of said second different external stimulations upon release.

* * * * *